US005315356A

United States Patent [19]

Nagato et al.

[11] Patent Number: 5,315,356

[45] Date of Patent: May 24, 1994

[54] FIXING APPARATUS

[75] Inventors: Hitoshi Nagato, Kawasaki; Yuzo Koike, Yokohama, both of Japan

[73] Assignee: Kabushiki Kaisha Toshiba, Kawasaki, Japan

[21] Appl. No.: 75,015

[22] Filed: Jun. 11, 1993

Related U.S. Application Data

[63] Continuation of Ser. No. 832,699, Feb. 7, 1992, abandoned.

[30] Foreign Application Priority Data

Mar. 16, 1991 [JP] Japan ..... 3-075559

[51] Int. Cl.[5] ..... G03G 15/20

[52] U.S. Cl. ..... 355/289; 219/216; 219/469

[58] Field of Search ..... 219/216, 282, 244, 469, 219/470, 471; 355/282, 285, 289; 338/214

[56] References Cited

U.S. PATENT DOCUMENTS

| | | | |
|---|---|---|---|
| 3,649,810 | 3/1972 | Tsuboi et al. | 219/216 |
| 3,883,213 | 5/1975 | Glaister | 339/61 |
| 4,013,871 | 3/1977 | Namiki et al. . | |
| 4,273,682 | 6/1981 | Kanamori | 252/551 |
| 4,292,261 | 9/1981 | Kotani et al. | 264/24 |
| 4,544,828 | 10/1985 | Shigenobu et al. | 219/216 |
| 4,825,041 | 4/1989 | Nagumo et al. | 219/244 |
| 5,084,738 | 1/1992 | Ishikawa | 355/285 |

FOREIGN PATENT DOCUMENTS

| | | |
|---|---|---|
| 0411852A3 | 2/1991 | European Pat. Off. . |
| 62-30280 | 2/1987 | Japan . |
| 62-85280 | 4/1987 | Japan . |

*Primary Examiner*—Michael L. Gellner
*Assistant Examiner*—Patrick J. Stanzione
*Attorney, Agent, or Firm*—Oblon, Spivak, McClelland, Maier & Neustadt

[57] ABSTRACT

A fixing apparatus, for fixing a toner on a recording material by using Joule heat which is generated by applying a voltage across the conductors or across the electrodes to supply a current mostly to a fixing portion, (I) comprises a heating device having a first conductive layer, a pressure-sensitive conductive resin layer which is formed on the first conductive layer, and a second conductive layer formed on the pressure-sensitive conductive resin layer, (II) comprises a heating device having a first conductor and a fixing sheet substantially made of a pressure-sensitive conductive resin layer and a second conductive layer, or (III) comprises a heating device having a fixing sheet made of a heat-generating resistor and first and second electrodes insulated from each other.

7 Claims, 8 Drawing Sheets

FIXING APPARATUS

This application is a Continuation of application Ser. No. 07/832,699, filed on Feb. 7, 1992, now abandoned.

BACKGROUND OF THE INVENTION

1. Field of the Invention

The present invention relates to a fixing apparatus of electrophotographic recording in which the power required for fixing is reduced.

2. Description of the Related Art

An electrophotographic recording apparatus has features such that it produces less noise as it is a non-impact recording apparatus, it can record characters clearly, its recording speed is high, and its running cost is relatively low. Therefore, it is recently used as an output terminal of OA equipment. The market of the electrophotographic recording apparatus is also quickly widening.

FIG. 1 is a schematic diagram of a recording apparatus of a laser printer as an example of the electrophotographic recording apparatus. The outline of the electrophotographic recording apparatus will be described. A conventional electrophotographic recording apparatus uses a photosensitive drum 100, as shown in FIG. 1. The entire surface of the photosensitive drum 100 is first uniformly charged to, e.g., about −700 V with negative charges by a charging apparatus 101 comprising a corona charger. Then, the photosensitive drum 100 is irradiated with a laser beam 102 in accordance with an image signal. The resistance of a portion of a photosensitive material which is irradiated with the beam is decreased. Therefore, an electrostatic latent image in which the negative charges are erased is formed at the portion irradiated with the laser beam 102. Usually, one semiconductor laser is used as the laser, and the beam modulated in accordance with the image performs scanning by a rotating polygonal mirror.

The electrostatic latent image formed in this manner is then developed by a developing apparatus 103. That is, when a developing bias of about −500 V is applied to the developing roller, a toner as fine color particles charged with, e.g., negative charges by reversal development attaches to the portion of the electrostatic latent image on the photosensitive drum 100 in which the negative charges are erased, thereby visualizing the latent image. Then, recording paper 105 which is picked up by paper feed rollers 104 from a paper cassette (not shown) is conveyed in synchronism with an image signal, and contacts the photosensitive drum 100. Transfer of the visualized toner image to the recording paper 105 is performed. In a transfer charger 106, positive charges are applied to, e.g., the lower surface of the recording paper 105. Thus, the negatively charged toner image on the photosensitive drum 100 is attracted to the recording paper 105 and transferred to it. The image-transferred recording paper 105 is then separated from the photosensitive drum 100 by a separation charger 107.

Finally, the toner is heated and pressed by a fixing apparatus 111 having a heat roller 110 and fixed on the recording paper 105, thereby completing recording. Note that part of the toner which is not transferred to the recording paper 105 remains on the photosensitive drum 100. The remaining toner on the drum 100 is cleaned by being scraped by a cleaner having a cleaning blade 108. Thereafter, the entire surface of the drum 100 is exposed to light by an erasure lamp 109 comprising an LED or the like, thereby erasing the charges on the photosensitive drum 100.

In this manner, in the electrophotographic recording apparatus, the steps of charging, formation of a latent image, development, transfer, and fixing are performed to form an image. The drum is cleaned in the cleaning step and is repeatedly used. Processes may differ more or less depending on the types of apparatuses but basically include the above steps.

The laser printer has been briefly described as a typical example of the electrophotographic recording apparatus. As the electrophotographic recording apparatus, not only a laser printer but also a recording head which uses other light-emitting elements for writing an electrostatic latent image have been developed and marketed. In the laser printer, a beam generated by one laser is radiated onto a polygonal mirror which rotates mechanically at a high speed or a hologram to scan the dots. A solid state scanning method which uses an array light source in view of reduction in system size and cost also currently has begun to attract attention. For example, an electrophotographic recording apparatus with a head in which light-emitting elements, e.g., LEDs, liquid crystal shutters, EL elements, plasma light-emitting elements, and fluovescent dot array, or light-shutter elements are arranged in an array has been put into practical use. Either electrophotographic recording apparatus described above is generally called an optical printer and utilized as an output apparatus, e.g., a printer or a digital copying machine. Another example of the electrophotographic recording apparatus is an analog copying machine in which the original is irradiated with light from, e.g., a conventionally used fluorescent lamp, and the light reflected by the original is guided to the photosensitive member to form an electrostatic latent image, thereby copying the original. Furthermore, another recording method called ion flow recording or ion deposition recording is also available. According to this method, a dielectric material is used in place of a photosensitive member. Ions are blown from pores formed in an array manner. An electrostatic latent image is formed on the dielectric material by the ions.

As has been described above, since the electrophotographic recording apparatuses have excellent features, they are often utilized recently as output terminal apparatuses of OA equipment. Various methods for them are developed and put into practical use, with their market rapidly expanding.

In these electrophotographic recording apparatuses, recording is performed in the common steps of charging, formation of a latent image, development, transfer, and fixing, as described above. One of the characteristic features of the electrophotographic recording apparatus is that a very low energy is required for forming an electrostatic latent image. For example, to form a latent image of one dot, a light energy of as small as about $10^{-6}$ to $10^{-5}$ J/cm$^2$ is applied to the photosensitive member. In contrast to this, to form one dot on a recording material by, e.g., a thermal transfer recording apparatus, a large recording energy of about 2 to 6 J/cm$^2$ is required. If only these facts are considered, an electrophotographic recording apparatus seems to have a very high efficiency and its power consumption seems to be very low compared to those of a thermal transfer recording apparatus.

In an actual electrophotographic recording apparatus, however, the power consumption is normally about 1.5 Kw in an apparatus which can record 8 to 12 sheets per minute, and is about 500 to 600 W at minimum in a low-speed apparatus which can record 4 sheets per minute. These values are of the same level or higher when compared with a thermal transfer recording apparatus. In the electrophotographic recording apparatus, some of the recording processes from charging to transfer of a toner image on plain paper are certainly realized with a very low energy. However, a high energy is consumed in the final step of fixing the toner to the recording material. Therefore, the power consumption as a whole in the electrophotographic recording apparatus is increased. For example, the fixing energy is as large as about several tens of $J/cm^2$, which is about ten times the recording energy of the thermal transfer recording apparatus.

Most electrophotographic recording apparatuses use a heat roll type fixing apparatus which performs fixing by heat and pressure. The fixing apparatus which uses a heat roll is safe as it is free from a danger such as ignition. Since the heat capacity is large, stable image quality can always be obtained. The fixing intensity is sufficiently higher than that of pressure fixing and the like.

However, since the heat roll has a large heat capacity, it takes time to increase the temperature of the heat rolls to a value required for fixing. Therefore, the apparatus cannot be used immediately after turning on the switch, and a warm-up time of about several minutes is usually necessary. Since the heat roll has a large heat capacity, a heater having high power consumption is needed, and thus, e.g., an infrared lamp of about 500 to 1,000 W is normally incorporated in the roller. In fine, the conventional electrophotographic recording apparatus uses a heat roll having a large heat capacity as the fixing apparatus. Therefore, although it has several advantages, it also has disadvantages in that high power consumption is needed and the warm-up time is long. When size reduction of the electrophotographic printing apparatus is considered, it is not preferable to use, as the fixing apparatus, a heat roll which has high power consumption and generates much heat.

SUMMARY OF THE INVENTION

The present invention has been made in view of the drawbacks of the conventional electrophotographic recording apparatus described above, and has as its object to provide an electrophotographic recording apparatus which requires low power consumption and a short warm-up time.

According to the present invention, there is provided a fixing apparatus which fixes a non-fixed toner image on a recording material by using Joule heat generated by flowing a current.

This fixing apparatus has three aspects as follows.

According to the first aspect of the present invention, the fixing apparatus comprises a heating means having a first conductive layer, a pressure-sensitive conductive resin layer which is formed on the first conductive layer and a volume resistivity of a pressed area of which becomes lower than that of a non-pressed area, and a second conductive layer formed on the pressure-sensitive conductive resin layer, wherein a current is supplied to a low-resistance pressed area of the pressure-sensitive conductive resin by bringing the heating means and a recording material into partial tight contact with each other and applying a voltage across the first and second conductive layers.

According to the second aspect of the present invention, the fixing apparatus comprises a heating means having a first conductor and a fixing sheet, the fixing sheet being substantially made of a pressure-sensitive conductive resin layer and a second conductive layer, wherein a current is supplied to a low-resistance pressed area of the pressure-sensitive conductive resin by partially applying pressure to contact with the fixing sheet against a recording material and applying a voltage across the first conductor and the second conductive layer.

According to the third aspect of the present invention, the fixing apparatus comprises a heating means having a fixing sheet made of a heat-generating resistor and first and second electrodes insulated from each other, wherein a current is supplied by arranging both the first and second electrodes on one surface of the fixing sheet such that they are close to but not contact with each other, pressing the first and second electrodes against a recording material through the medium of the fixing sheet, and applying a voltage across the electrodes.

In the fixing apparatus of the present invention, the heating means, e.g., a heat roller need not be entirely heated, unlike in the conventional fixing apparatus, and heat generated at only the pressed portion of the roller surface is efficiently conducted to the toner to be fixed and the recording material around it. As a result, the fixing step can be executed by heat of several $J/cm^2$, and the power consumed by fixing is decreased to about 1/10 that required by the conventional apparatus.

According to the present invention, since the pressed portion of the heating means and the recording material can be caused to generate heat instantaneously, the warm-up time can be set to almost 0 when the fixing apparatus is used at a normal temperature.

Also, according to the present invention, fixing can be performed only when an image is present. When only a portion of the recording material on which a non-fixed toner is present, or a portion around it is selectively heated, in this manner, the power consumption can be further decreased to about a fraction.

When a pressure-sensitive conductive resin is used in the heating means, since the temperature distribution of the resin surface of the powered pressed portion is uniform, non-uniform fixing does not easily occur. Furthermore, since the pressure-sensitive conductive resin has a characteristic to self-control its temperature at an upper limit value, ignition or a sticking phenomenon that the toner is fused on the roller, both of which are caused by an excessive temperature increase, can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The present invention will be described in detail with reference to the accompanying drawings.

The present invention has been made to solve the problems described above and has the following three aspects.

According to the first aspect of the present invention, there is provided a fixing apparatus comprising a heating means having a first conductor, a pressure-sensitive conductive resin layer which is formed on the first conductor and a volume resistivity of a pressed area of which becomes lower than that of a non-pressed area, and a second conductive layer formed on the pressure-sensitive conductive resin layer, and a current supplying means for supplying a current to a low-resistance pressed area of the pressure-sensitive conductive resin layer by applying a voltage across the first and second conductive layers, wherein a non-fixed toner image on a recording material partially pressed against the heating means is fixed by using Joule heat generated by the current.

Figure 1:
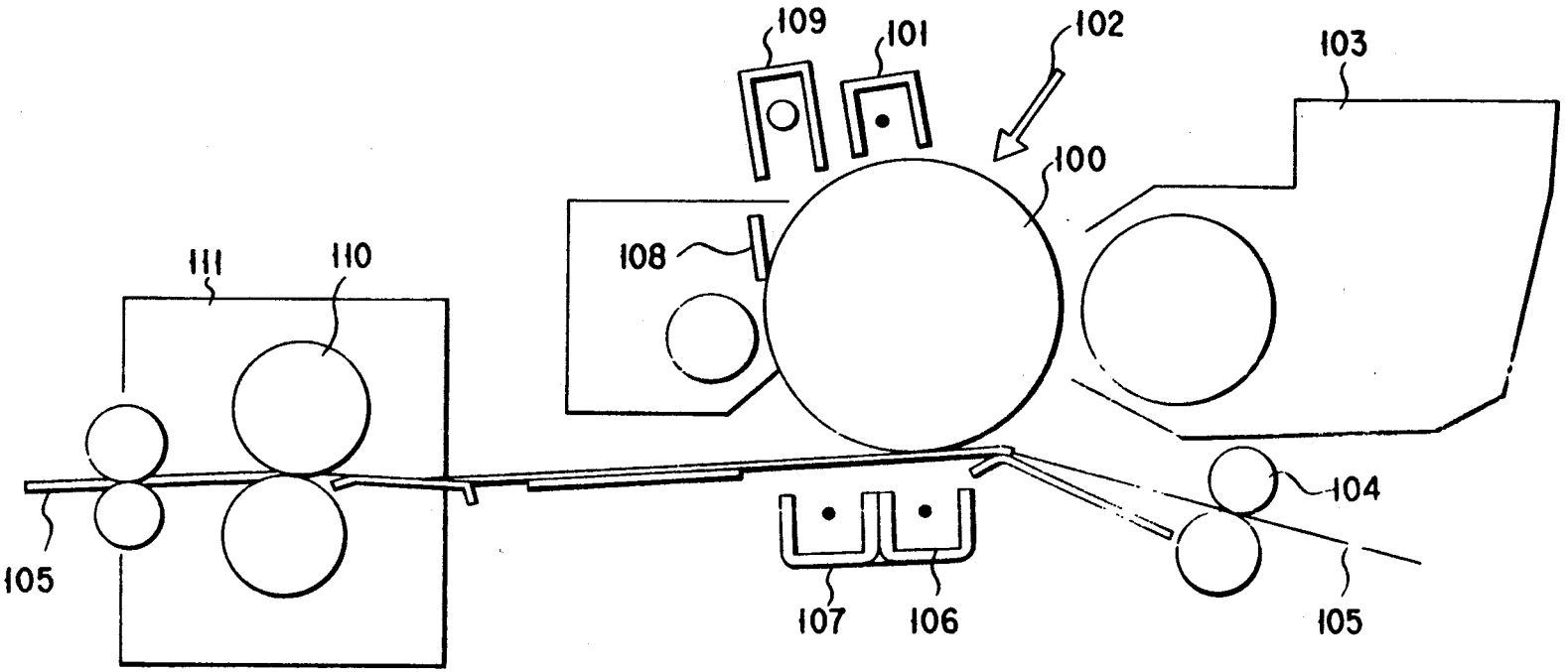
FIG. 1 is a schematic diagram showing an arrangement of an electrophotographic recording apparatus having a fixing apparatus using a conventional heat roller.
Figure 2A:
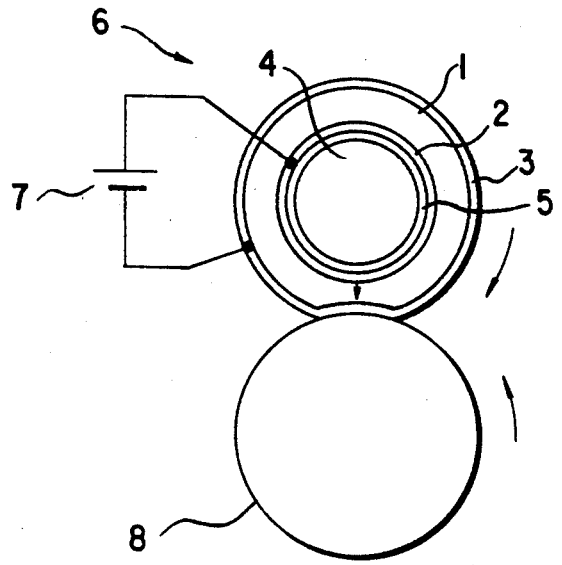
FIG. 2A is a schematic diagram showing an arrangement of a fixing means of a fixing apparatus according to the present invention.
Figure 2B:
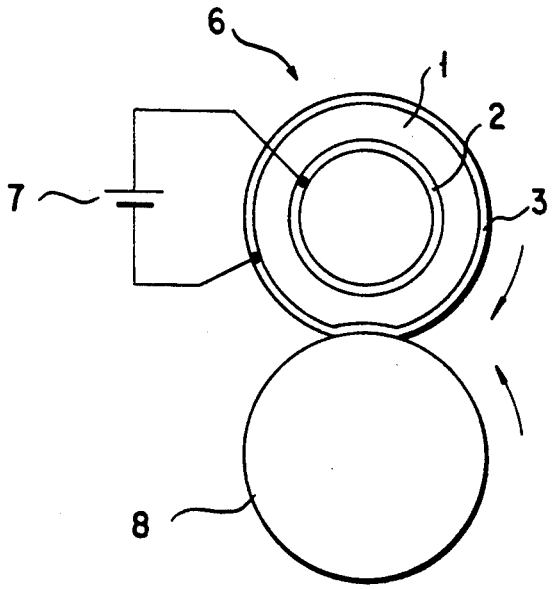
FIG. 2B is a schematic diagram showing another arrangement of the fixing means of the fixing apparatus according to the present invention.

FIGS. 2A and 2B are views each showing a fixing apparatus according to the first aspect of the present invention. In the fixing apparatus shown in FIG. 2A, the heating means is made to have a roller shape, as shown in FIG. 2A, and is used. First, a heat insulating layer 5 is formed on the circumferential surface of a columnar or hollow cylindrical core roller 4 made of a metal, ceramic, or the like. Thereafter, a first conductive layer 2, a pressure-sensitive conductive resin layer 1, and a second conductive layer 3 are sequentially formed on the heat insulating layer 5 to form a heat roller 6. A power supply 7 is connected between the first and second conductive layers 2 and 3 of the heat roller 6. The power supply 7 is connected between the first and second conductive layers 2 and 3 at least during fixing because it is a power supply for generating heat for fixing. A press roller 8 is brought into tight contact with such a heat roller 6 to constitute the fixing apparatus of the present invention. That is, recording paper (not shown) on which a non-fixed toner image is formed is conveyed, from the right in FIG. 2A, to a nip portion between the heat and press rollers 6 and 8 which are rotated as they are in tight contact with each other, as indicated by arrows in FIGS. 2A and 2B. The recording paper passes between the rollers 6 and 8, and the power supply 7 is connected during this period of time. When the heat roller 6 generates heat, fixing is performed. FIG. 2B shows a fixing apparatus having substantially the same arrangement as that of FIG. 2A except for the following respects. That is, in FIG. 2B, a first inner conductive layer 2 is a hollow cylindrical conductive layer made of, e.g., a metal having a thickness of about 1 mm, and the conductive layer 2 also serves as the supporting member for the roller. With this arrangement, the heat insulating layer 5 can be omitted.

Figure 3:
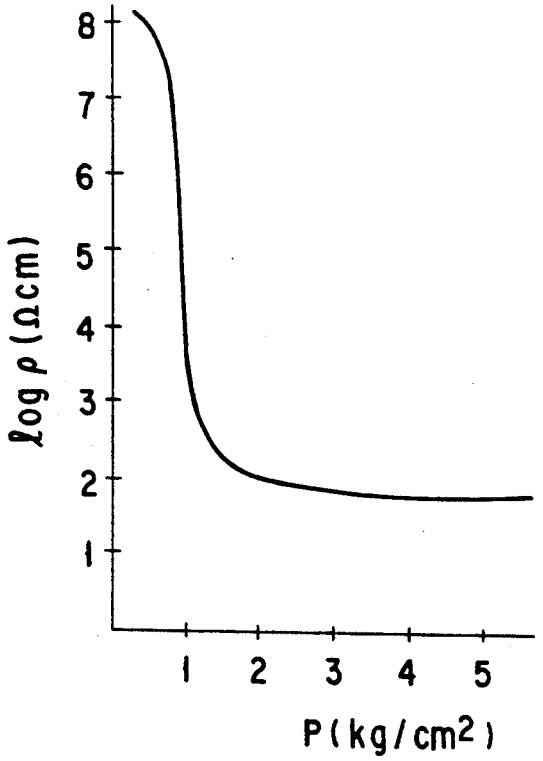
FIG. 3 is a graph showing a change in resistivity of a pressure-sensitive conductive resin used in the present invention against a pressure.

FIG. 3 is a graph showing an example of a pressure characteristic of the pressure-sensitive conductive resin layer 1. The axis of abscissa represents a pressure P ($kg/cm^2$) applied to the pressure-sensitive conductive resin layer 1, and the axis of ordinate represents a volume resistivity $\rho$ ($\Omega$·cm) of the pressure-sensitive conductive resin layer 1 in logarithm. When a pressure of a certain level is applied to the pressure-sensitive conductive resin, its volume resistivity $\rho$ normally sharply decreases to 1/10 to $1/10^6$, as shown in FIG. 3. Such a nature of the pressure-sensitive conductive resin is utilized in the fixing apparatus of the present invention, which is one of the characteristic features of the present invention. When the heat and press rollers 6 and 8 are brought into tight contact with each other, as shown in FIGS. 2A and 2B, a large pressure is applied to the contacting portion of the pressure-sensitive conductive resin layer 1. In this case, if the pressure acting on the pressed contacting portion is 2 $kg/cm^2$, the volume resistivity $\rho$ of this portion is about $10^2$ $\Omega$·cm, as is apparent from FIG. 3. Similarly, the volume resistivity $\rho$ of the non-pressd portion is about $10^8$ $\Omega$·cm. The total resistivity across the first and second conductive layers 2 and 3 is calculated by setting the diameter and the length of the heat roller 6 at 16 mm (roller circumference is about 5 cm) and A4 (=20 cm for the sake of simplicity), respectively, and the thickness of the pressure-sensitive conductive resin layer 1 at 100 $\mu$m.

When the heat roller 6 is not pressed, a total resistivity $R_0$ of the first and second conductive layers 2 and 3 is:

$$R_0 = 10^8\ \Omega\cdot cm \times 0.01\ cm/(5\ cm \times 20\ cm) = 10\ k\Omega \quad (1)$$

In contrast to this, a resistivity $R_1$ of a pressed portion of the heat roller 6 is:

$$R_1 = 10^2\ \Omega\cdot cm \times 0.01\ cm/(0.1\ cm \times 20\ cm) = 0.5\ \Omega \quad (2)$$

if the nip width is, e.g., 1 mm. A total resistivity R between first and second conductive layers 2 and 3 when the heat and press rollers 6 and 8 are in tight contact with each other is substantially the same as the resistivity $R_1$ of the pressed portion. That is, when the power supply 7 is applied, more than 99% (in this case) of the current is concentrated to the pressed portion, and a large amount of Joule heat is generated at this portion. The non-fixed toner on the recording paper is fixed by this heat.

In the conventional fixing method, the entire roller having a large heat capacity is heated. In contrast to this, according to the fixing method of the present invention, only the surface of the heat roller, and especially only the portion pressed by the recording paper is caused to generate heat, in the manner as described above. Therefore, the power consumption of the fixing apparatus is greatly decreased.

At the pressed portion, the temperature of the toner and the recording sheet in its vicinity must be increased so that the heat quantity generated there is sufficient for melting the toner while the non-fixed toner image passes through the pressed portion. The time required by the toner image to pass through the pressed portion of the heat roller differs depending on the recording speed. In a normal low-speed printer, if the nip width is 0.1 to 0.2 cm, the passing time is several tens to several hundreds of msec. In order to heat the toner and the recording paper in its vicinity to a temperature (usually about 200° C.) required for fixing a toner during such a short period of time, the heat capacity of the portion around the heat generating member must be decreased. An example of the measure for this purpose includes formation of the heat insulating layer 5 by, e.g., a resin having a high heat resistance under the first conductive layer 2. With this heat insulating layer 5, the heat generated by the pressure-sensitive conductive resin layer 1 is prevented from being conducted to the core roller 4. Another example of this measure is to decrease the heat capacity by decreasing the thickness of the pressure-sensitive conductive resin layer 1. The heat resistance and heat capacity of the resin differs depending on the thickness of the pressure-sensitive conductive resin layer 1. It is preferable that the thickness of the pressure-sensitive conductive resin layer 1 used in this case is set to 3 mm or less, and it is ideal if it is set to 1 mm or less.

In this manner, the heat capacity of the pressure-sensitive conductive resin layer 1 can be decreased by decreasing the thickness of the pressure-sensitive conductive resin layer 1. Therefore, the surface temperature at the pressed portion of the heat roller can be rapidly increased by Joule heat generated in the vicinity of the pressed portion of the heat roller. Furthermore, the resistivity of the pressure-sensitive conductive resin layer can be decreased by decreasing its thickness. When the resistivity is decreased, a larger current can be caused to flow, and thus a larger amount of Joule heat can be instantaneously generated. In the conventional heat roller and the like, a roller having a large heat capacity is uniformly heated and used a the fixing roller. This is to prevent the fixing temperature from being quickly decreased, which happens because the heat of the rollers is deprived of by the recording paper when the recording paper passes through the fixing rollers. However, although to increase the heat capacity of the rollers is effective in increasing the fixing strength of the image, it leads to an increase in power consumption. As described above, according to the present invention, since a large amount of heat can be instantaneously generated, the fixing temperature is not easily decreased while the recording paper passes.

The first and second conductive layers 2 and 3 can be formed by vapor deposition of a metal, e.g., Al. In this case, since the conductivity of the metal is very high, a current can be sufficiently caused to flow if the conductive layer has a thickness of at least 1,000 Å. Also, a conductive layer may be formed by coating conductive coating composition. In this case, according to a simple method, the core roller is repeatedly dipped in and pick up from a conductive coating composition mass to obtain an uniform film thickness. In this case, since the conductivity of the conductive coating is not so high as the metal, to sufficiently flow the current, the conductive layer needs a thickness of several to several tens of μm. Since the second conductive layer 3 on the outer side directly contacts the toner, it is necessary to prevent toner offset. If the second conductive layer 3 is formed in accordance with the method as described above, an offset does not substantially occur, and even if it does occur, it will not substantially affect the image. Therefore, no problem arises if the second conductive layer 3 is used as it is. In order to completely eliminate the offset, a layer for preventing toner adhesion may be formed on the second conductive layer 3 by coating, e.g., fluoroplastic to about 10 μm. The offset can also be eliminated by performing cleaning with a blade used by the conventional heat roller.

Figure 4:
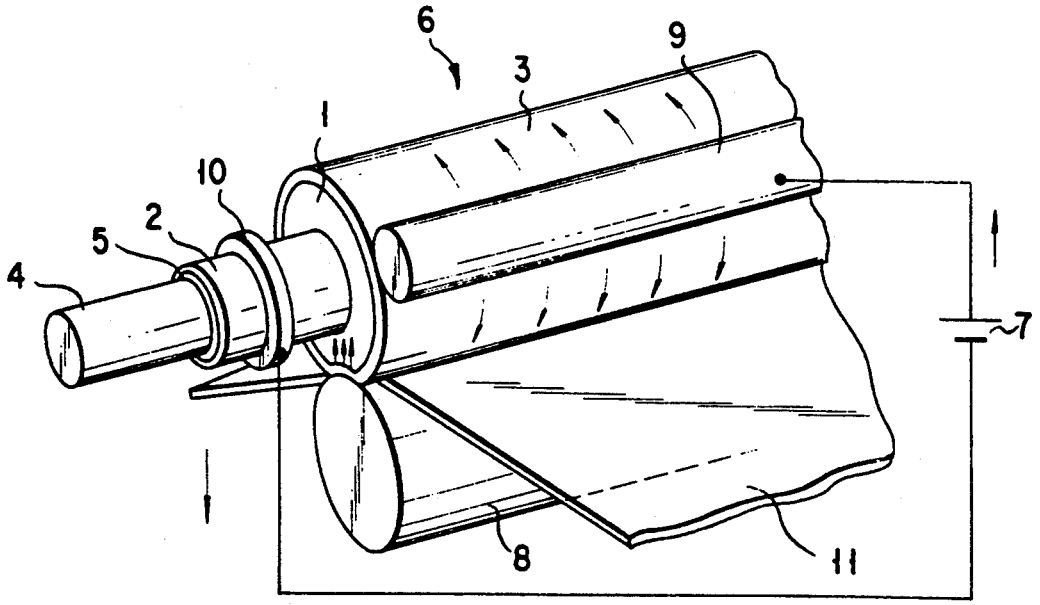
FIG. 4 is a schematic view showing an arrangement of the fixing apparatus according to the present invention.

FIG. 4 is a perspective view showing a practical arrangement of the fixing apparatus based on the fixing apparatus shown in FIG. 2A. A heat insulating layer 5 is formed on a core roller 4 serving as a shaft, and a first conductive layer 2 is formed on the heat insulating layer 5. A pressure-sensitive conductive resin layer 1, in which conductive particles are dispersed in silicone rubber, is formed on the first conductive layer 2, and a second conductive layer 3 is formed on the resin layer 1, thereby constituting a heat roller 6. To connect a power source to the first conductive layer 2, the first conductive layer 2 is formed wider than the pressure-sensitive conductive resin layer 1 or second conductive layer 3, and the first conductive layer 2 is partially exposed from the roller, as shown in FIG. 4. A power source 7 can be connected to the first conductive layer 2 by bringing a metal piece, a metal brush, or a metal bearing 10, as shown in FIG. 4, into contact with the exposed portion. The power source 7 can be connected to the second conductive layer 3 by bringing a metal piece, a metal brush, or a metal roller electrode 9, as shown in FIG. 4, into contact with the second conductive layer 3 provided on the surface of the heat roller 6. Recording paper 11 on which a non-fixed toner image is formed is passed through between the heat roller 6 having this arrangement and a press roller 8 being in tight contact with the heat roller 6, and the power source 7 is connected, thereby performing fixing. When the power source 7 is connected as shown in FIG. 4, the current flows from the power source 7 in the order of the roller electrode 9, the second conductive layer 3, the pressed portion of the pressure-sensitive conductive resin layer 1, the first conductive layer 2, the bearing 10, and the power supply 7, as indicated by arrows in FIG. 4. Joule heat is generated at the pressed portion of the pressure-sensitive conductive resin layer 1, and the toner is fixed.

Figure 5:
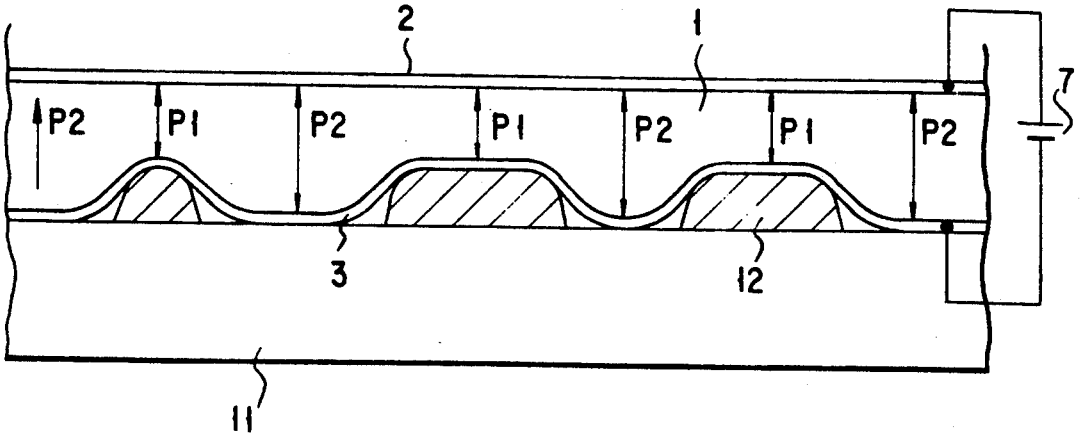
FIG. 5 is a schematic diagram showing another arrangement of a fixing apparatus according to the present invention.

Another fixing apparatus embodying the first aspect of the present invention will be described. Regarding conservation of the fixing power, it is realized most if only a portion of the heat roller where a non-fixed toner image exists can be caused to generate heat. FIG. 5 shows a case in which the fixing apparatus described above is modified to achieve further power conservation based on this idea. As shown in FIG. 5, a non-fixed toner 12 on recording paper 11 is normally deposited to a thickness of several 10 μm. This is because a normal toner has a particle size of about 10 μm and is deposited as several layers on the recording paper 11 before fixing. Even after fixing, the toner 12 usually has a thickness of about 10 μm. Thus, when an area in which the toner image 12 before fixing is pressed against a pressure-sensitive conductive resin layer 1 is enlarged, a state as shown in FIG. 5 is obtained. That is, a portion of the pressure-sensitive conductive resin layer 1 on which the non-fixed toner image 12 exists is pressed with a large force because of the deposited toner height, and the pressure at this portion becomes higher than that at a portion of the pressure-sensitive conductive resin layer 1 on which the non-fixed toner image 12 does not exist. As a result, a higher pressure P1 acts on a portion where the toner attaches, and a low pressure P2 lower than the pressure P1 acts on a portion where the toner does not attach, as shown in FIG. 5, thus forming a pressure distribution on the pressure-sensitive conductive resin layer 1. In this manner, further efficient fixing can be performed by utilizing a change in pressure between a toner-present portion and a toner-absent portion.

Figure 6:
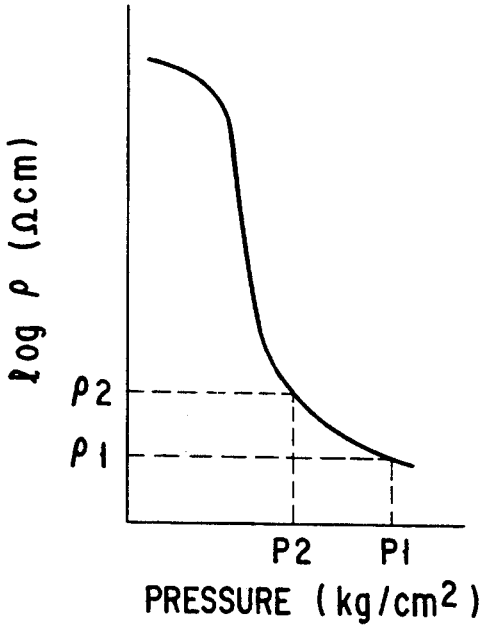
FIG. 6 is a graph showing a change in resistivity of a pressure-sensitive conductive resin, used in the fixing apparatus shown in FIG. 5, against a pressure.
Figure 7:
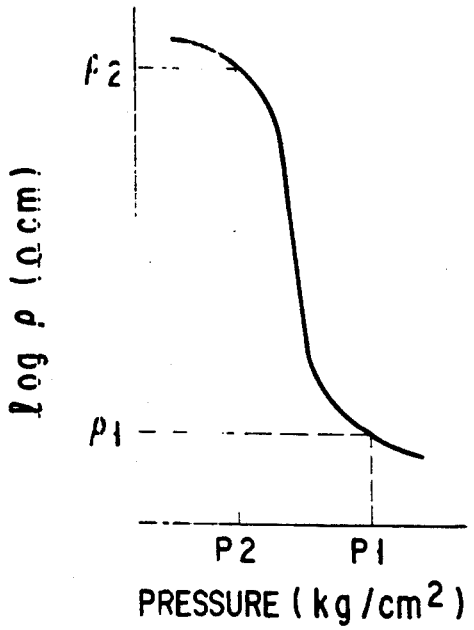
FIG. 7 is a graph showing a change in resistivity of another pressure-sensitive conductive resin, used in the fixing apparatus shown in FIG. 5, against a pressure.

FIGS. 6 and 7 show graphs each indicating a relationship between the volume resistivity of a pressure-sensitive conductive resin and a pressure. As shown in FIG. 3, the pressure-sensitive conductive resin in the arrangements of FIGS. 2A and 2B has a pressure resistance characteristic which is saturated at a constant value when a pressure is applied. In the arrangement of FIG. 5, the pressure-sensitive conductive resin is set to have such a pressure resistance characteristic that the volume resistivity $\rho$ changes depending on the pressure, as shown in, e.g., FIG. 6 even when the pressure is applied. This can be realized by appropriately selecting the type and amount of the dispersed particles. When such a pressure-sensitive conductive resin is used, since the pressure at a portion where a non-fixed toner is present is P1, the corresponding volume resistivity is $\rho 1$, and since the pressure at a toner-absent portion is P2 which is lower than P1, the corresponding volume resistivity is $\rho 2$ which is higher than $\rho 1$. In this state, when the power source 7 is connected between the first and second conductive layers 2 and 3, since the resistivity is lowest at the portion where the non-fixed toner 12 is present, the current flowing through it is largest, and the generated heat quantity is largest accordingly. In this case, the portion where no toner is present also generates heat. However, when compared to the case in which the pressure-sensitive conductive resin of the characteristic of FIG. 3 is used, the efficiency is improved since the heat is centralized at the portion where the toner 12 is present. Therefore, this arrangement is suited for saving power.

FIG. 7 shows a pressure resistance characteristic of a pressure-sensitive conductive resin having a further improved efficiency. In this case, a volume resistivity $\rho$ of the pressure conductive resistivity sharply changes between a pressure P1 at a portion where a non-fixed toner 12 is present and a portion P2 where no toner is present. This ca also be realized by appropriately selecting the type and amount of the dispersed particles. When the pressure-sensitive conductive resin having such a pressure resistance characteristic is used, the current substantially flows mostly at a portion where the non-fixed toner 12 is present, and thus most efficient, fixing with saving power can be realized. Note that in order to realize a saved-power fixing apparatus which sufficiently utilizes this characteristic, it is necessary to control the pressure. For example, in ordinary recording paper, the thickness of the paper fiber is not even and thus can lead to the surface non-evenness of about 10 μm, and this non-evenness changes the pressure. The pressure is different in a recording paper having a different thickness as well. That is, when a lowest-power fixing apparatus is fabricated by utilizing the characteristic shown in FIG. 7, the obtained apparatus can be used in a recording apparatus which performs recording on exclusive paper, e.g., a resin sheet, which has no surface non-evenness and change in thickness. In this case, since only a portion where the toner is present generates heat, the fixing efficiency is the best. The present invention has been described above by referring to cases in which a pressure-sensitive conductive resin is formed to have a roller-shape and is used. A case will be described in which a sheet-shaped pressure-sensitive conductive resin is used.

According to the second aspect of the present invention, there is provided a fixing apparatus comprising a heating means having a first conductor and a fixing sheet, the fixing sheet being made of a pressure-sensitive conductive resin layer and a second conductive layer formed on the pressure-sensitive conductive resin layer, and a current source means for supplying a current to a low-resistance pressed area of the pressure-sensitive conductive resin by applying a voltage across the first conductor and second conductive layer, wherein a non-fixed toner image on a recording material partially pressed by the fixing sheet is fixed by using Joule heat generated by the current.

Figure 8:
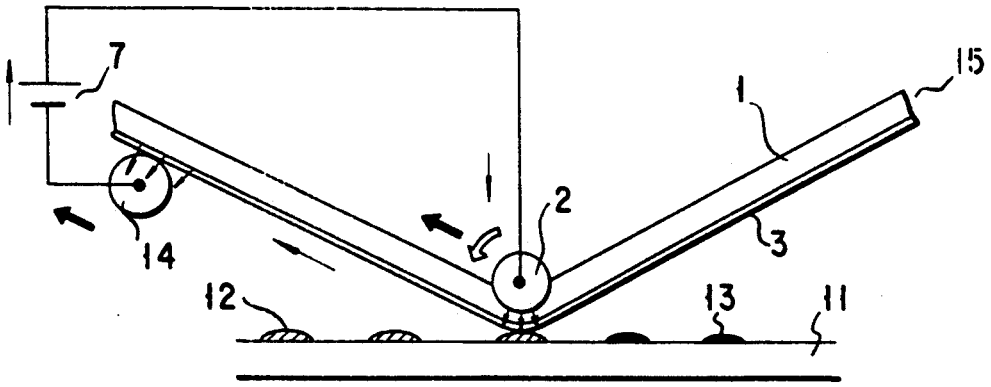
FIG. 8 is a schematic diagram showing an arrangement of the fixing apparatus using the fixing sheet according to the present invention.

FIG. 8 shows a fixing apparatus using a sheet-shaped pressure-sensitive conductive resin layer 1. A fixing sheet 15 in which a second conductive layer 3 is formed on one surface of the pressure-sensitive conductive resin layer 1 is used in this fixing apparatus. The conductive layer 3 may be formed by depositing a metal, e.g., aluminum, by vapor deposition or by coating a conductive coating composition. The fixing sheet 15 is arranged such that the second conductive layer 3 opposes a surface of recording paper 11 on which a non-fixed toner image 12 is formed. A roller made of, e.g., a metal as a first conductor 2 is pressed on the other surface of the fixing sheet 15 against the recording paper 11, on which the non-fixed toner image 12 is formed, through the medium of the fixing sheet 15. The first conductor 2 is connected to one terminal of a power source 7. The second conductive layer 3 is brought into contact with a conductive piece, a conductive brush, or a metal roller electrode 14, as shown in FIG. 8. The roller electrode 14 is connected to the other terminal of the power source 7. The fixing apparatus is thus constituted. Since a pressure is applied to the fixing sheet 15 by the metal roller as the first conductor 2, the resistivity at this portion is decreased, and a current flows mostly in this pressed portion. A current flows along the path indicated by thin arrows in FIG. 8, the pressed portion of the pressure-sensitive conductive resin generates heat, and the non-fixed toner 12 on the recording paper 11 is fixed by this heat, thereby forming a fixed toner image 13. The metal roller as the first conductor 2 is moved in a direction indicated by thick black arrows relative to the fixing sheet 15 together with the roller electrode 14 while it is rotated on the fixing sheet 15 in a direction indicated by a thick white arrow, thereby fixing the toner on the entire recording paper 11.

Figure 9:
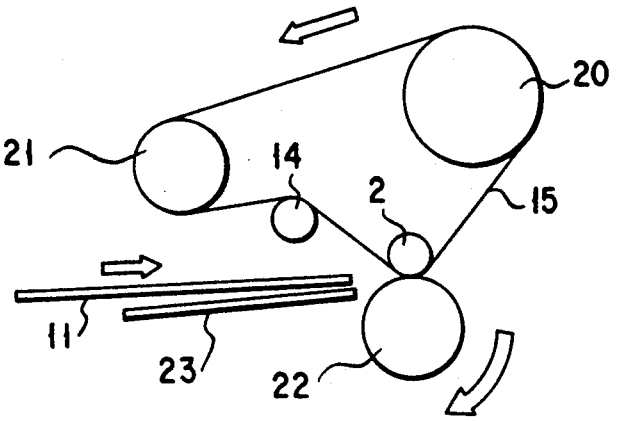
FIG. 9 is a diagram showing an arrangement of a fixing apparatus using an endless belt-shaped fixing sheet.

FIG. 9 is a view schematically showing an arrangement of a fixing apparatus which uses the sheet-shaped fixing apparatus 15. The fixing sheet 15 used in this fixing apparatus has a similar structure as that shown in FIG. 8 and is obtained by forming a conductive layer on one surface of a pressure-sensitive conductive resin sheet. An endless belt is formed of such a fixing sheet 15, and is looped among three rollers including a drive roller 20, a tension roller 21, and a first conductor 2, as shown in FIG. 9. The fixing sheet 15 is driven by the drive roller 20 to travel as indicated by a hollow arrow. The tension roller 21 applies a predetermined tensile force to the traveling fixing sheet 15 so that the fixing sheet 15 does not become loose. The first conductor 2 is pressed against a backup platen 22 through the medium of the fixing sheet 15, and the backup platen 22 is rotated in synchronism with the fixing sheet 15, as indicated by another hollow arrow. Recording paper 11, on which a non-fixed toner image is formed, is fed from a previous step to the fixing apparatus, as indicated by still another hollow arrow. Then, the recording paper 11 is guided by a paper guide 23 to pass through the pressed portion between the fixing sheet 15 and the backup platen 22. A metal roller electrode 14 contacts a surface of the fixing sheet 15 on which the conductive layer is formed, and a voltage is applied across the first conductor 2 and the conductive layer of the fixing sheet 15. When the recording paper 11 enters the pressed portion between the fixing sheet 15 and the backup platen 22, a voltage is applied across the first conductor 2 and the roller electrode 14. Since the pressed portion has a low resistance, a current flows through this pressed portion, and the toner on the recording paper 11 is fixed. Since the fixing sheet 15 is endless and driven by the drive roller 20 as indicated by the arrow, the heat-generating pressed portion continuously travels over the fixing sheet 15. Fixing can be performed on the entire surface of the recording paper in this manner. The surface of the fixing sheet 15 which contacts the electrode 14 directly contacts the toner. When a conductive layer on which aluminum or the like is deposited by vapor deposition is used, a toner offset which affects subsequent recording does not substantially occur. In order to prevent the influence of the toner offset more effectively, a cleaning apparatus using a blade as used in a conventional heat roller can be used. The offset can also be prevented by coating the surface of the fixing sheet 15 which contacts the toner with, e.g., fluoroplastic. In this case, however, the roller electrode 14 cannot contact the conductive layer of the fixing sheet 15. Therefore, it is preferable to think out a way with which the roller electrode 14 contacts the fixing sheet 15. For example, the width of the fixing sheet 15 may be set larger than that of the recording paper, only a portion of the fixing sheet 15 which contacts with the recording paper may be coated with a resin, and the roller electrode 14 may be brought into contact with a non-coated portion of the fixing sheet 15.

To use such a fixing sheet in a fixing apparatus is disadvantageous in terms of size reduction when compared to a fixing roller. In the roller type fixing apparatus, however, the heat generated on the roller surface is not sufficiently insulated even if a heat insulating layer is provided in the roller, and the heat tends to be conducted to the core of the roller to cause a thermal loss. In comparison to this, when a fixing sheet is used, the power consumption can be further economized since the fixing sheet is perfectly held in the air.

Figure 10:
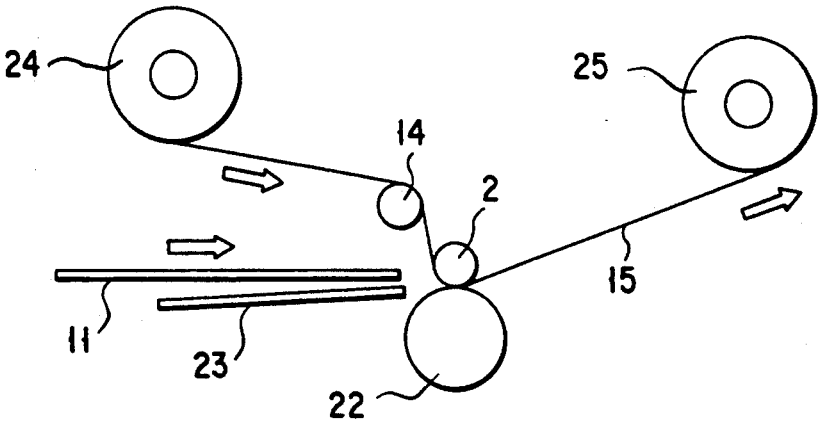
FIG. 10 is a diagram showing an arrangement of a fixing apparatus using a rolled fixing sheet.

FIG. 10 shows another arrangement of a fixing apparatus using a fixing sheet 15 using the sheet-shaped pressure-sensitive conductive resin. In FIG. 9, the endless belt-shaped fixing sheet 1 is used. In FIG. 10, a rolled fixing sheet 15 is used. The fixing sheet 15 is wound on a supply reel 24. The fixing sheet 15 first contacts a roller electrode 14, passes through a pressed portion between a first conductor 2 and a backup platen 22, and is taken up by a take-up reel 25. The fixing sheet 15 is taken up by the take-up reel 25 in synchronism with a timing at which recording paper 11 on which a non-fixed toner image is formed passes through the pressed portion of the first conductor 2, fixing sheet 15 and the backup platen 22. To use such a rolled fixing sheet is advantageous in that a fixing sheet can be fabricated by using an inexpensive material having a low heat-resisting property. If a fixing roller or endless belt is used, the pressure conductive sheet need to have a service life almost the same as that of the recording apparatus itself. In contrast to this, when a rolled fixing sheet as described above is used, it is disposable after being used once, and thus a material having a low heat-resisting property or a thin fixing sheet can be used. If the fixing sheet is of a type which can be used several times, when fixing on one or several continuous sheets of recording paper is completed, the fixing sheet is rewound, used until a service life is reached, and replaced by a new fixing sheet, thereby minimizing the amount of the fixing sheet used. If the fixing sheet is of a type which can be used ten times, when fixing on one recording paper is completed, the fixing sheet is rewound by a length corresponding to 9/10 a single recording sheet, and one fixing sheet is used ten times in this manner, thereby economizing the fixing sheet. Note that when a rolled fixing sheet as shown in FIG. 10 is used, it needs replacement. Therefore, it is preferable that a fixing sheet roll is fabricated as a cassette so that it can be easily replaced.

According to the third aspect of the present invention, there is provided a fixing apparatus comprising a heating means having a fixing sheet made of a heat-generating resistor, and first and second electrodes arranged on one surface of the fixing sheet to be close to and but not contact each other and pressed against a recording material through the medium of the fixing sheet, and a current supplying means for supplying a current across the first and second electrodes by applying a voltage thereacross, wherein a non-fixed toner image on the recording material is fixed by using Joule heat generated by a portion of the fixing sheet through which the current flows.

Figure 11A:
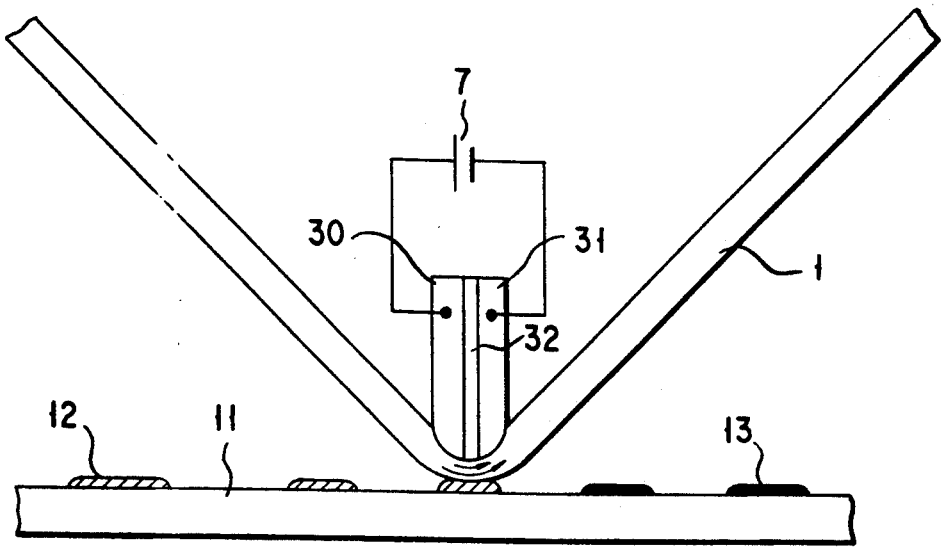
FIG. 11A is a schematic diagram showing an arrangement of a fixing apparatus in which a pair of electrodes are arranged on one surface of a fixing sheet to be close to each other.
Figure 11B:
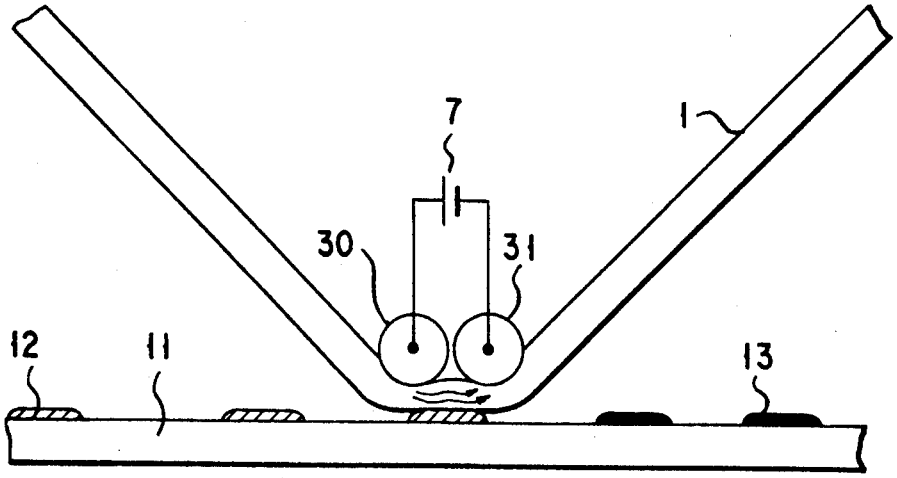
FIG. 11B is a schematic diagram showing another arrangement of the fixing apparatus in which a pair of electrodes are arranged on one surface of a fixing apparatus to be close to each other.

FIGS. 11A and 11B show still other arrangements of a fixing apparatus using a fixing sheet. In the arrangement of FIG. 11A, a power supply 7 is connected between a pair of electrodes 1 (30) and 2 (31) sandwiching an insulating layer 32 therebetween. Using these electrodes (30, 31), recording paper 11 on which a non-fixed toner image 12 is formed is pressed through the medium of a pressure-sensitive conductive resin 1. A current is supplied to the pressed portion of the pressure-sensitive conductive resin 1 to flow from the electrode 1 (30) to the electrode 2 (31) as indicated by arrows in FIG. 11A to cause the pressed portion to generate heat, thereby forming a fixed image 13. In this fixing apparatus, two electrodes 1 (30) and 2 (32) are pressed against one surface of the pressure-sensitive conductive resin 1, unlike in the fixing apparatuses described above.

In the fixing apparatus shown in FIG. 11B, a pair of electrodes comprise rollers, and a power source 7 is connected between the roller electrodes 1 (30) and 2 (31). By using the roller electrodes (30, 31), a pressure-sensitive conductive resin 1 is pressed against recording paper 11 on which a non-fixed toner image 12 is formed. A current is supplied to the pressed portion of the pressure-sensitive conductive resin 1 to flow from the electrode 1 (30) to the electrode 2 (31) as indicated by arrows in FIG. 11B to cause the pressed portion to generate heat, thereby forming a fixed image 13. In this method as well, the two roller electrodes 1 (30) and 2 (31) are pressed against one surface of the pressure-sensitive conductive resin 1 in the method of FIG. 11B.

In the cases of FIGS. 11A and 11B, a pressure-sensitive conductive resin sheet can be used as it is. That is, unlike in the fixing apparatuses described above, a conductive layer need not be formed on one or two surfaces of the pressure-sensitive conductive resin 1. As a result, the cost of the fixing apparatus is decreased, and the thermal or mechanical strength becomes higher than that of a fixing apparatus using a fixing sheet or roller made of two different materials. Even if such a pressure-sensitive conductive resin is used, in an actual fixing apparatus, it can be formed as an endless belt type fixing sheet as shown in FIG. 9 or a roll type fixing sheet as shown in FIG. 10. A pressure-sensitive conductive resin can be formed in a roll-shaped. In this case a roller type fixing apparatus can be pressed internally by an electrode, or externally at upstream and downstream portions of the pressed portion.

Figure 12:
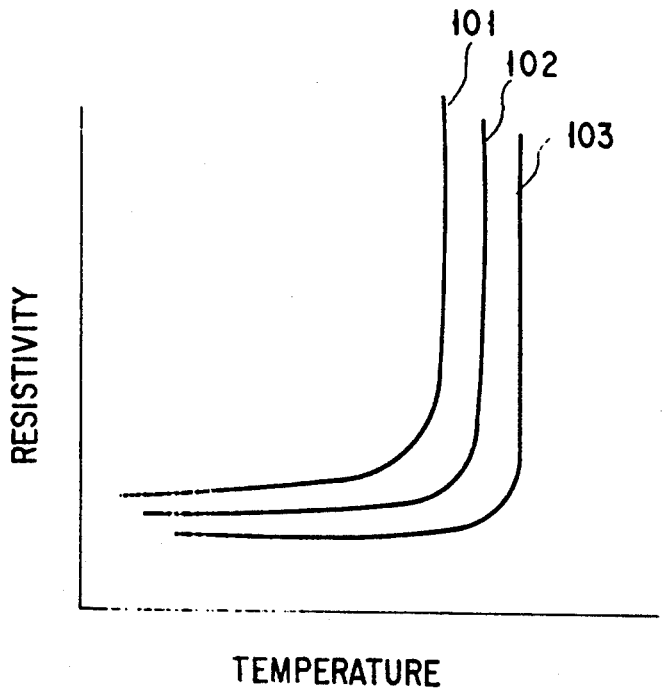
FIG. 12 is a graph showing a change in resistivity of a pressure-sensitive conductive resin used in the present invention against a temperature.

A typical example of the pressure-sensitive conductive resin includes a pressure conductive rubber. A pressure conductive rubber obtained by dispersing in a silicone rubber a conductive material, e.g., particles of carbon black or a nickel-based metal, or spherical metal particles of, e.g., copper or nickel, can be used. To obtain an appropriate resistivity, the dispersion amount may be controlled, or carbon black and metal particles may be mixed at an appropriate dispersion ratio. FIG. 3 is a graph showing a change in resistivity in a pressure-sensitive conductive resin used in the present invention against a pressure. FIG. 12 is a graph indicating a relationship between a temperature and a resistance of a pressure-sensitive conductive resin. In FIG. 12, the pressure is increased in the order of curves 101, 102, and 103. A major feature of the pressure conductive rubber resides in an acute increase in resistance at a specific temperature when the temperature is increased as shown in FIG. 12. This is assumed to be caused by a change in thermal expansion coefficient between the rubber and the dispersed conductive material particles. That is, when the temperature is increased, only the rubber portion expands, and the distance between dispersed particles is increased, resulting in a sharp increase in resistance. When the pressure is increased, the temperature at which this sharp increase occurs is increased.

The present invention positively utilizes such a feature of the pressure-sensitive conductive resin. That is, when the temperature is low at the initial stage of heat generation, the resistance is low, and thus a large current can be supplied, thereby generating a large amount of heat instantaneously. Therefore, the heat will not be deprived of by the recording material to destabilize fixing, as described above. When the temperature is gradually increased to exceed a predetermined value, the resistance is sharply increased so that the current cannot flow easily. Since the temperature can be self-controlled in this manner, the fixing apparatus is not excessively heated, and the fixing temperature can be substantially stabilized.

The fixing sheet used in this arrangement is not limited to the pressure-sensitive conductive resin sheet described above, but other heat-generating resistor sheets can be used.

Although several arrangements of the present invention have been described, the present invention is not limited to them. According to the present invention, e.g., a pressure-sensitive conductive resin is used, the pressure-sensitive conductive resin is pressed against recording paper on which non-fixed toner image is formed, a current is supplied mostly to the pressed portion, and the toner is fixed by utilizing Joule heat which is generated in the pressure-sensitive conductive resin by the current. The fixing apparatus of the present invention can be of any type as far as it aims at generation of Joule heat mostly at the pressed portion, in this manner, and is not limited to the arrangements described above.

The power source for supplying a current to the pressure-sensitive conductive resin need be connected only while the recording paper on which a non-fixed toner image is formed passes through the fixing apparatus. That is, in the conventional heat roller method, it takes time to increase the temperature of the heat roller to a toner fixing capable temperature. Therefore, preheating must be performed even when no recording paper is fed, and the entire roller must always be heated, even during a wait time, by occasionally supplying power to the heater. In contrast to this, according to the fixing method of the present invention, since only a surface of the roller, and especially a portion thereof which is pressed by the recording paper can be instantaneously heated, the roller need be caused to generate heat only while the recording paper passes through the fixing apparatus, thereby performing fixing. In this respect as well, sufficient saving power, when compared to the conventional fixing method, can be realized. In the fixing apparatus of the present invention, since the temperature of the roller surface can be instantaneously increased up to the toner fixing enable temperature, further saving power is possible. That is, it is not that the power source for supplying a current to the pressure-sensitive conductive resin is connected only while the recording paper passes. Rather, fine control is performed and the power source is connected only when a non-fixed toner image is present on the recording paper, so that further saving power can be realized. In particular, when the fixing apparatus of the present invention is used in a laser printer or the like, substantially blank recording paper with a very small recording amount is sometimes output. In this case, the fixing energy need only be applied to only the portion where the recording image is present. In this manner, when the fixing power source is connected only when an image is present, further saving power becomes possible. ON/OFF control of heat generation is realized by, e.g., detecting image data in a memory if the fixing apparatus is used in a laser printer.

As has been described above, according to the present invention, e.g., a member obtained by sandwiching two opposite surfaces of a pressure-sensitive conductive resin with first and second conductors can be used as a heating means. When this heating member and a recording material on which a non-fixed toner image is formed are partially brought into tight contact with each other, the resistance in a pressed portion of the pressure-sensitive conductive resin is decreased, and the volume resistivity of this portion becomes, e.g., $10^3$ [Ω·cm] or less. In contrast to this, the volume resistivity of a non-pressed portion remains at, e.g., $10^8$ [Ω·cm] or more. Therefore, when a voltage is applied across the first and second conductors described above, it flows mostly to the low-resistance pressed portion through the pressure-sensitive conductive resin.

The member obtained by sandwiching such a pressure-sensitive conductive resin with two conductive layers is applied on, e.g., a roller surface to constitute a heat roller, and a backup roller is pressed against the heat roller. When a voltage is applied across the two conductive layers of the heat roller, a current flows through the pressure-sensitive conductive resin, so that the heat roller surface is caused to generate Joule heat. When a recording material on which a non-fixed toner image is formed is passed through the heat and backup rollers, fixing is performed.

In the fixing apparatus having the above-described configuration, since the heat and backup rollers are partially pressed against each other through the recording material, a current flows mostly to this pressed portion. That is, mostly a portion of the pressure-sensitive conductive resin of the heat roller which contacts the recording material generates heat. The non-fixed toner on the recording material is fixed by this heat. Since the heat roller is rotated, the portion which mostly generates heat is sequentially shifted on the roller. In the fixing apparatus using the conventional heat roller, the heat roller is internally heated to increase the temperature of the entire roller, thereby performing fixing. When compared to this conventional method, according to the fixing apparatus of the present invention, only the surface of the heat roller, and especially a portion thereof which contacts the recording material is caused to generate heat to perform fixing. Therefore, energy required for fixing can be greatly saved.

The thickness of the toner-present portion is larger than that of the toner-absent portion by an amount corresponding to the height of the coated toner. Therefore, when the recording material is pressed between the heat and backup rollers, the pressure acting on the toner-present portion becomes larger than that on the toner-absent portion. Accordingly, the resistance across the first and second conductive layers becomes smallest at the toner-present portion, and mostly the toner-present portion generates heat. Further efficient fixing can be realized in this manner.

When efficient fixing is realized in this manner, power can be saved. Furthermore, in a normal operating state, the warm-up time can be decreased nearly to 0.

The resistance of the pressure-sensitive conductive resin used in the present invention has the temperature characteristic as shown in FIG. 12. When a local temperature drop occurs in such a pressure-sensitive conductive resin due to a variation in resistance, thickness, outer air, or by an object that contacts the pressure-sensitive conductive resin, power source is controlled to be supplied until the temperature becomes a predetermined value at this portion. When the fixing apparatus of the present invention is used, the temperature distribution of the surface of the powered pressure-sensitive conductive resin is kept uniform in this manner. As a result, fixing non-uniformity does not occur. Similarly, since the fixing apparatus has a characteristic to self-control its temperature at an upper limit, ignition or a sticking phenomenon that the toner is fused on the roller, both of which are caused by an excessive temperature increase, can be prevented.

In addition, according to the present invention, when the pressure-sensitive conductive resin is used, the heat-generating portion itself need not have a heat capacity, but only a pressed portion pressed by the recording material need to generate heat. When the temperature does not increase, the resistances of the pressed and non-pressed portion are different by 10,000 to 100,000 times. Therefore, a current can be efficiently supplied to only a needed portion, and when a maximum current is supplied to the pressed portion, the fixing apparatus can be started more quickly. Furthermore, since the heat-generating method of the fixing apparatus of the present invention is of the pin-point heat generation type in which heat is supplied to only the nip width or to a small area comprising of the toner-present portion, the heat quantity to be deprived of is small, and good fixing can be performed to color copy paper having a thick toner layer or a recording material having a high moisture amount as well.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A fixing apparatus comprising:

a heat roller having a first conductor, a pressure-sensitive conductive resin layer which is formed on said first conductor and in which a volume resistivity of a pressed area becomes lower than that of a non-pressed area, and a second conductive layer formed on said pressure-sensitive conductive resin layer; and current supplying means for supplying a current to a low-resistance pressed area of said pressure-sensitive conductive resin layer by applying a voltage across said first and second conductive layers, wherein a non-fixed toner image on a recording material partially pressed against said heat roller is fixed by using Joule heat generated by flowing of the current.

2. An apparatus according to claim 1, wherein a pressure-sensitive conductive rubber is used as said pressure-sensitive conductive resin.

3. An apparatus according to claim 1, wherein said first conductor has a core or hollow roll shape.

4. An apparatus according to claim 1, wherein said second conductive layer comprises a metal layer formed on said pressure-sensitive conductive resin layer by vapor deposition.

5. An apparatus according to claim 1, wherein said second conductive layer comprises a conductive composition coating formed on said pressure-sensitive conductive resin layer.

6. An apparatus according to claim 1, wherein the volume resistivity when pressed is between 1/10 and $1/10^6$ of the volume resistivity when non-pressed.

7. An apparatus according to claim 1, wherein the volume resistivity when pressed is measured when said pressure-sensitive conductive resin layer is pressed with a pressure of 2 $kg/cm^2$.

* * * * *